US008708384B2

(12) United States Patent
Boland

(10) Patent No.: US 8,708,384 B2
(45) Date of Patent: Apr. 29, 2014

(54) CARRYING HANDLE

(71) Applicant: Thomas Boland, Bayside, NY (US)

(72) Inventor: Thomas Boland, Bayside, NY (US)

( * ) Notice: Subject to any disclaimer, the term of this patent is extended or adjusted under 35 U.S.C. 154(b) by 0 days.

(21) Appl. No.: 13/767,232

(22) Filed: Feb. 14, 2013

(65) Prior Publication Data

US 2013/0241224 A1 Sep. 19, 2013

Related U.S. Application Data

(60) Provisional application No. 61/633,598, filed on Feb. 14, 2012.

(51) Int. Cl.
*A45F 5/00* (2006.01)

(52) U.S. Cl.
USPC ..... 294/158; 294/159; 294/87.2

(58) Field of Classification Search
USPC ..... 294/158, 159, 160, 87.1, 87.2, 27.1, 294/137; 206/151, 158, 162, 153; 16/425
See application file for complete search history.

(56) References Cited

U.S. PATENT DOCUMENTS

| | | | | | |
|---|---|---|---|---|---|
| D29,333 | S | | 9/1898 | Seymour | |
| D30,403 | S | | 3/1899 | Sherwood | |
| 2,122,025 | A | | 6/1938 | Crary | |
| 2,578,878 | A | * | 12/1951 | Buttery | 229/195 |
| 3,044,105 | A | | 7/1962 | Bertil | |
| 3,083,886 | A | * | 4/1963 | Fry | 294/159 |
| D204,295 | S | | 4/1966 | Brekke | |
| D222,767 | S | | 12/1971 | Alfano | |
| 3,913,172 | A | | 10/1975 | Richards et al. | |
| 4,153,314 | A | | 5/1979 | Prater | |
| 4,168,025 | A | | 9/1979 | Bantner | |
| D303,336 | S | | 9/1989 | Webster | |
| D306,699 | S | * | 3/1990 | Michau | D9/432 |
| D321,135 | S | * | 10/1991 | Bedell et al. | D9/434 |
| D364,806 | S | | 12/1995 | Cole | |
| D410,386 | S | | 6/1999 | Watkins | |
| 5,947,351 | A | * | 9/1999 | Garofalo et al. | 294/159 |
| 6,334,531 | B1 | * | 1/2002 | Valkovich | 206/163 |
| 6,536,820 | B1 | | 3/2003 | Dean et al. | |
| D492,864 | S | | 7/2004 | Mizusawa | |
| D519,834 | S | | 5/2006 | Novakovich et al. | |
| 7,090,272 | B2 | | 8/2006 | Novakovich et al. | |
| 7,306,272 | B2 | * | 12/2007 | Riness | 294/15 |
| 7,331,622 | B2 | * | 2/2008 | Sewell | 294/159 |
| 7,588,225 | B2 | * | 9/2009 | Wawerski | 16/425 |
| 7,588,276 | B1 | | 9/2009 | Bibow | |
| D605,937 | S | | 12/2009 | Lovelace et al. | |
| D625,560 | S | | 10/2010 | Olson et al. | |
| 7,874,602 | B2 | | 1/2011 | Meckwood et al. | |
| 8,313,132 | B2 | * | 11/2012 | Kuzma et al. | 294/159 |
| D673,834 | S | * | 1/2013 | Boland | D8/313 |

* cited by examiner

*Primary Examiner* — Paul T Chin
(74) *Attorney, Agent, or Firm* — Brad M. Behar & Associates, PLLC

(57) ABSTRACT

The present invention is a light weight, rigid, carrying handle that allows a single user to safely and securely transport multiple cylinders with one hand. The carrying handle consists of a rectangular grip plate, a tab at each end of the grip plate extending away from the grip plate about perpendicular to the surface of the grip plate, and a grip guard on each side of the grip plate also extending away from the grip plate about perpendicular to the surface of the grip plate. The tabs and grip guards all preferably extend in the same direction away from a inner surface of the carrying handle. The tabs are configured thin such that it can be inserted into and through an opening in a cylinder collar bracket.

12 Claims, 25 Drawing Sheets

CARRYING HANDLE

CROSS-REFERENCE TO RELATED APPLICATION

This application is a non-provisional utility patent application that claims the benefit of U.S. Provisional Patent Application Ser. No. 61/633,598 filed on Feb. 14, 2012 which is expressly incorporated herein in its entirety by reference thereto.

FIELD OF THE INVENTION

The present invention relates generally to the transportation of cylinders, and specifically oxygen cylinders commonly used with backpack respirators. More particularly, the invention is a carrying handle whose primary purpose is to facilitate the safe and efficient transportation of multiple cylinders at the same time.

The invention is a single carrying handle, a pair of carrying handles, or more than two carrying handles, that are light, rigid, and compact that allow a single person to carry multiple cylinders with one device, preferably in one hand.

BACKGROUND OF THE INVENTION

The profession of fighting fires includes numerous inherent dangers. Beyond the obvious risks associated with getting burned by a fire's flames, firefighters also face many other safety hazards associated with fire when entering a burning structure. One of the essential fuels necessary for fire and the combustion of materials is oxygen. As a fire burns and spreads throughout a structure its flames continuously deplete the atmospheric oxygen inside the structure. As the fire burns hotter, it can cause oxygen levels within the structure to drop to dangerously low levels. During the early stages of a fire there is usually more oxygen available than the fire can consume. The fire's burn rate will typically slow down as the levels of oxygen inside the structure are depleted. The fire can only consume oxygen at the rate at which additional oxygen can enter the area in which the fire is burning. This phenomenon causes incomplete combustion, which results in the production of toxin laden smoke comprised of deadly particles, vapors and gases. In addition to the structure itself, its contents will also burn during a fire. Various toxins are released into the structure's atmosphere as the structure and its contents burn. Depending on the structure's composition and contents, the levels of toxins released into the atmosphere can be significantly high. Some toxins that are produced during combustion include carbon monoxide, hydrogen chloride, hydrogen cyanide, carbon dioxide, nitrogen dioxide, phosgene, ammonia and chlorine. The structure's rooms will often fill with the toxic smoke making it nearly impossible for anyone inside the structure to breath. The low concentrations of oxygen and high concentrations of smoke within a structure during a fire make for significantly difficult and hazardous conditions that firefighters need to overcome in order to stay within the structure long enough to rescue victims trapped inside and extinguish the fire.

A backpack respirator, also known as a Self Contained Breathing Apparatus (SCBA), is an essential piece of equipment used by firefighters. SCBAs allow firefighters to breath while they are inside a burning structure thereby permitting them to remain within the hostile environment for longer durations.

The SCBAs are typically comprised of a frame, a harness system that straps to the fireman's shoulders, back and waist, an air cylinder and valve connected to a faceplate-mounted regulator and a face mask with head harness. The frame and harness system support an inverted cylinder filled with oxygen on the fireman's back so that the cylinder's valve assembly faces downward when the cylinder tank is installed on the SCBA's frame. Some SCBAs are configured so as to support two cylinders side-by-side, thereby increasing the SCBA's maximum potential runtime.

The oxygen cylinders used with SCBAs have housings that are typically constructed from aluminum. The aluminum housing is often wrapped with a fiber composite to help further strengthen and protect the cylinder. The cylinder housing has a base at its distal end and a neck at its proximal end. The housing's base can be either flat, about flat or it can be rounded/spherical. At the proximal end of the cylinder housing, fixedly or removably attached to the housing's neck, is the cylinder's valve assembly. The valve assembly usually threads into the cylinder housing's neck.

The cylinder valve assembly is comprised of several components, including a cylinder hanger bracket or cylinder collar bracket. Cylinder hanger brackets (or cylinder collar brackets) are configured so as to be secured to cylinders in different ways. Some cylinder brackets are secured to the cylinder using screws or bolts which pass through mounting holes on the cylinder bracket and thread directly into either the cylinder's valve assembly or housing. Other cylinder brackets include a round aperture at the end opposite the bracket slot where the cylinder's neck and valve assembly pass through. The cylinder bracket is then firmly pressed in place upon the cylinder's neck by the cylinder's valve assembly.

Regardless of how a cylinder bracket attaches to the cylinder, one element common to all cylinder brackets is an aperture near one of the cylinder bracket's ends known as a bracket slot. The bracket slot is always positioned away from the cylinder when the cylinder bracket is installed upon the cylinder and is used when securing the cylinder to a SCBA. The cylinder bracket is used to connect the cylinder to the SCBA's frame assembly and support it on the SCBA. The SCBA frame and harness typically includes a hook at the base of the frame designed to engage the bracket slot on the cylinder bracket. The SCBA's hook serves the dual purpose of keeping the cylinder in place within the frame and partially supporting the weight of the cylinder on the fireman's back. Additional harnesses and/or fasteners on the SCBA wrap around the cylinder's housing to securely fasten the cylinder in place within the SCBA's frame.

The oxygen cylinders used with SCBAs are categorized according to their duration ratings. Some standard cylinders include the 30, 45 and 60 minute sizes. The length/height of the different cylinders is approximately the same although their diameters will vary according to their rated durations. The cylinders with higher duration ratings generally have larger diameters than cylinders with lower duration ratings. Although their ratings and diameters may vary, the bracket slots of cylinder brackets found on cylinders with different ratings still remain the same, allowing cylinders with different ratings to be used interchangeably with the same SCBA.

The different duration ratings of cylinders are determined by a National Institute for Occupational Safety and Health (NIOSH) Breathing Machine Test which simulates an average adult at a moderate work rate of 40 liters per minute. The duration ratings are only estimated durations of how long the cylinders are expected to deliver oxygen to the respirator when the respirator is in use. The actual durations may vary considerably depending on several factors, including the physical condition of the user, the user's degree of physical activity, the degree of training or experience the user has with the particular respirator, whether or not the cylinder is fully charged at the start of the work period, the atmospheric pressure in the area in which the respirator is being used, the fit of the faceplate on the user and on the condition of the SCBA. Typically, oxygen cylinders will last for shorter durations and will need to be replaced more often when firemen are more active, when the fire is hotter and when the level of toxins in the atmosphere is high. This is primarily caused because the fireman's level of oxygen demand and consumption will be significantly higher under such conditions. Accordingly, firemen often need to replace their oxygen cylinders while fighting a single fire. Especially before entering a larger structure, such a multi-floor building, or when faced with a more severe fire, firefighters will often carry additional oxygen cylinders into a building with them to avoid having to exit the structure and return to the fire truck for replacement cylinders in the midst of fighting the fire. In addition to using oxygen cylinders with their SCBAs, in certain instances fireman also need to carry extra cylinders for use with various air-driven rescue tools such as air lifting bags, and air driven impact tools used to break through concrete and stone. Further, in addition to carrying spare oxygen cylinders, firefighters also need to carry other rescue tools such as halligan bars, axes, picks, flashlights, and wire cutters when entering a burning structure.

Firefighters usually carry spare cylinders in their hands by grasping the cylinder from its valve assembly. In doing so, they are usually limited to carrying one cylinder in each hand, assuming each hand is free, which is most often not the case do to the need to carry other equipment. Some firefighters, depending on their size and strength, try grasping two cylinders in each hand although this is often very difficult and unstable, particularly when travelling up and down a burning building's stairwell while also trying to carry additional equipment. Still others attempt to carry two replacement cylinders by using a rope tied to the valve assembly of each cylinder and then draping the rope with the suspended cylinders over their shoulder(s). Again, this is a very unstable method of transporting cylinders because the cylinders can swing uncontrollably as the fireman maneuvers through the burning structure. The swinging cylinders can strike other rescuers, and can cause the fireman carrying the cylinders to lose his/her balance due to the shifting load. Another issue with using a rope to carry cylinders is that with wear, the rope can deteriorate causing it to eventually break or snap. This is especially likely to occur when the rope is in use under the stress of the weight. A rope loaded with cylinders that breaks unexpectedly while a fireman is transporting the cylinders can cause the cylinders to fall and possibly hurt the fireman and/or anyone else within his/her general vicinity. Yet another major problem with this method of transporting cylinders includes the added time necessary to fasten and unfasten the rope to each of the cylinders by tying the rope to the cylinder valves. The time it takes to tie and undue the knots in the rope will ultimately result in a slower response time to secure and replace cylinders on the SCBA. The time can be even longer in the event the fireman is unable to untie the knots in the rope. The added time spent fumbling with the rope can have deadly consequences for the fireman whose original cylinder is completely depleted and who is trying to install a new cylinder before running out of breath. The need to wear gloves during a fire also makes tying and untying knots difficult.

Oxygen cylinders are typically stored horizontally in both the firehouse and on fire trucks using special cylinder racks. Firefighters will routinely remove cylinders from the racks one at a time when they need to be used, or serviced. When the firefighters have finished using or servicing the cylinders they will then replace them back upon the racks, again one cylinder at a time. Having to remove and replace cylinders from the racks one at a time can be a time consuming process. Performing the task at a quicker rate may require the involvement of additional man power. In the event of an emergency the time it takes to perform this task can be critical. Furthermore, devoting additional people to accomplish the task during an emergency, when they can be better utilized somewhere else, can be detrimental to the firefighters' rescue efforts.

SUMMARY OF THE INVENTION

The present invention is a device that can be used to overcome the aforementioned issues relating to the transportation of oxygen cylinders by allowing a plurality of cylinders to be carried in one hand. While the invention will be described in connection with certain embodiments, it will be understood that the invention is not limited to those embodiments. To the contrary, the invention includes all alternatives, modifications and equivalents as may be included within the spirit and scope of the present invention.

The present invention is a light weight device that allows a single user to safely and securely transport multiple cylinders with one hand. In one embodiment of the invention the device consists of a pair of carrying handles, specifically an inner or first handle and an outer or second handle. Each carrying handle consists of a grip plate, a tab at either end of the grip plate and a grip guard at either side of the grip plate. The tabs and grip guards all extend in the same direction away from the surfaces of the grip plates, together forming an inner cavity in each carrying handle. The inner or first carrying handle is so dimensioned, so as to slide into the inner cavity of the outer or second carrying handle, allowing the two carrying handles to be compact during storage, thereby making it easier for a user to carry and store when not in use.

The tabs are configured so as to be complementary in cross sectional shape to the cylinder bracket slots found on cylinders, so that the tabs may slide into and through the bracket slots. By sliding the tabs of the carrying handles through the cylinder bracket slots, a user may removably attach the carrying handles to cylinders. Grasping the carrying handles and lifting them, the user can transport four cylinders using his/her two hands, without the assistance of a second person. Alternatively, the user could only use one of the two carrying handles to transport two cylinders, leaving his/her other hand free.

DETAILED DESCRIPTION OF THE INVENTION

Figure 1:
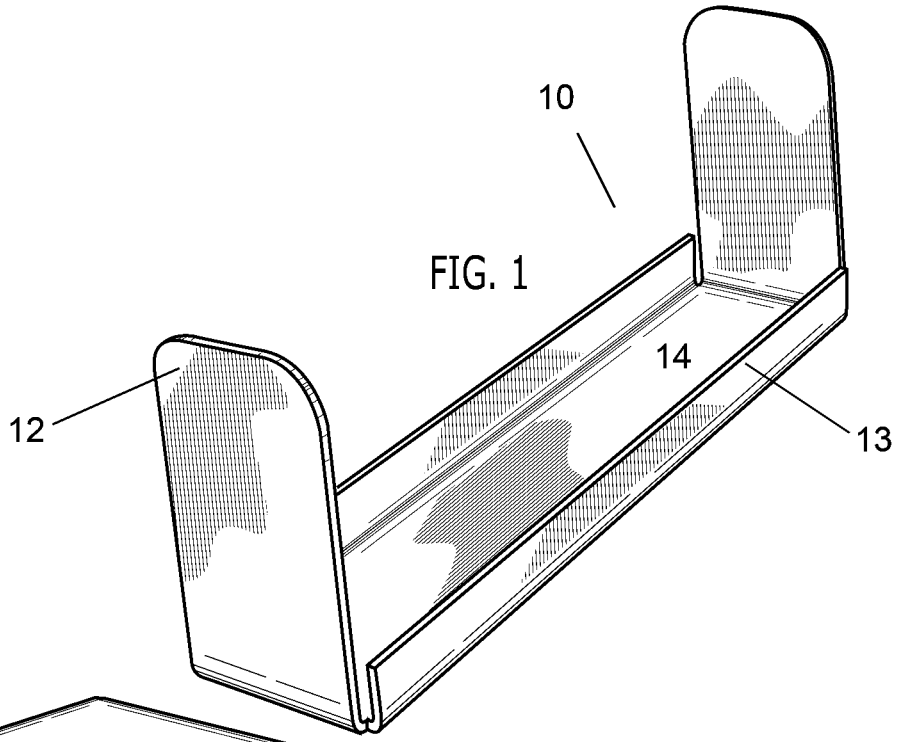
FIGS. 1-6 are perspective views, side views, front views, top views and bottom views of an embodiment of the outer carrying handle.
Figure 2:
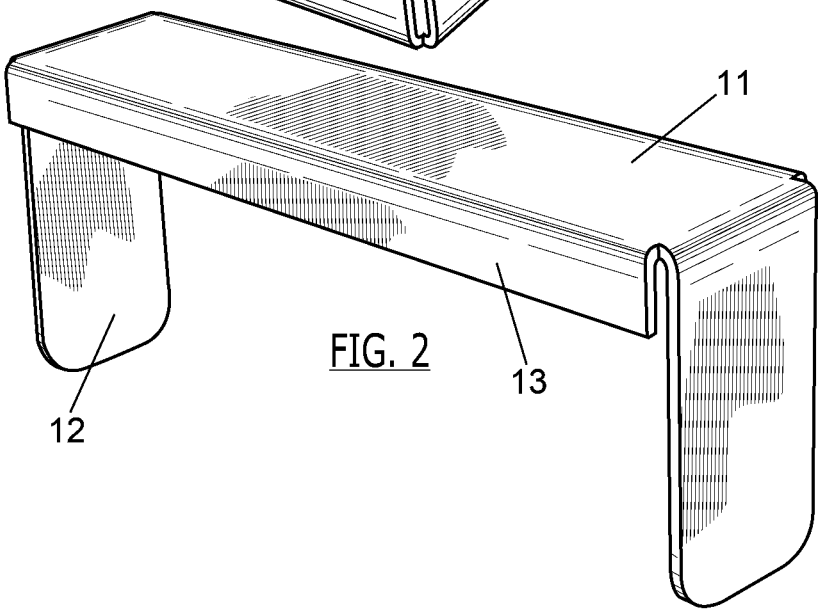
Figure 3:
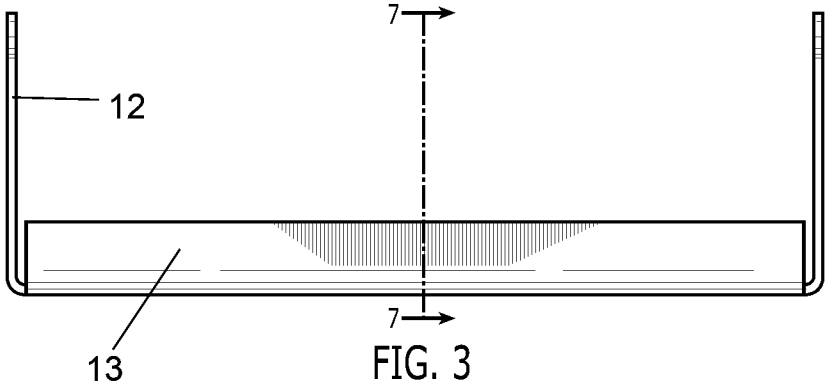
Figure 4:
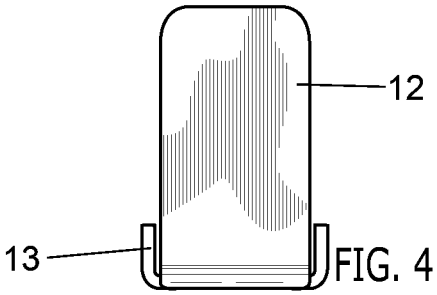
Figure 5:
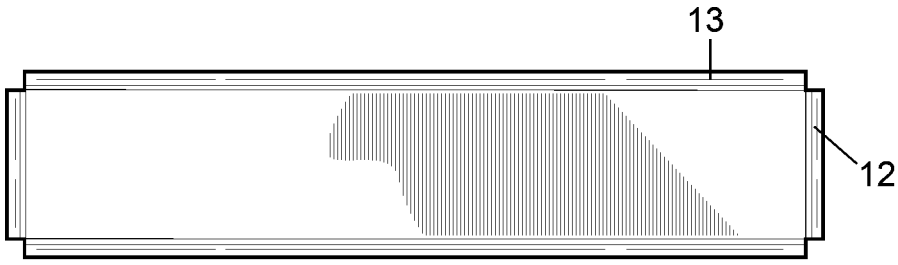
Figure 6:
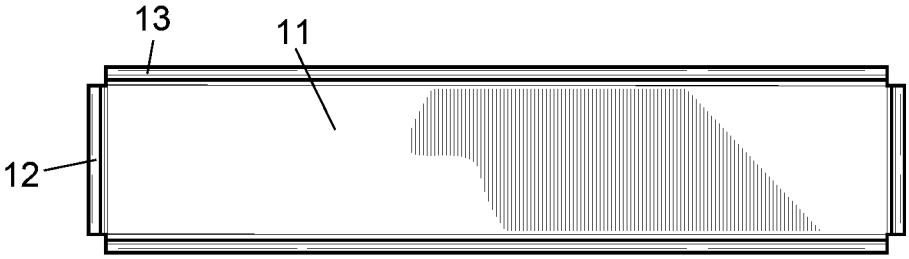
Figure 7:
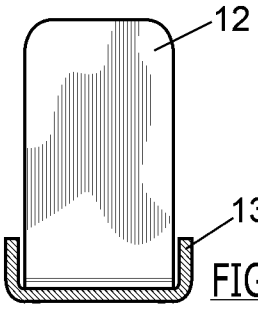
FIG. 7 is a cross-sectional view of the embodiment of the outer carrying handle shown in FIG. 3 taken in the direction of the arrows on line 7-7.
Figure 8:
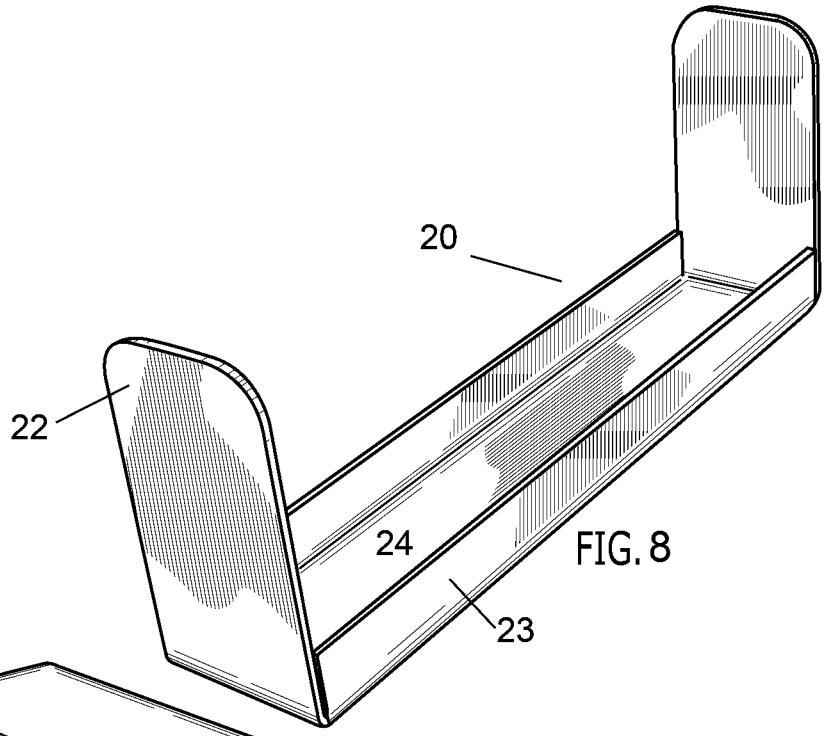
FIGS. 8-13 are perspective views (FIGS. 8 and 9), a side view (FIG. 10), a front view (FIG. 11), a top view (FIG. 12), and a bottom view (FIG. 13) of an embodiment of the inner carrying handle.
Figure 9:
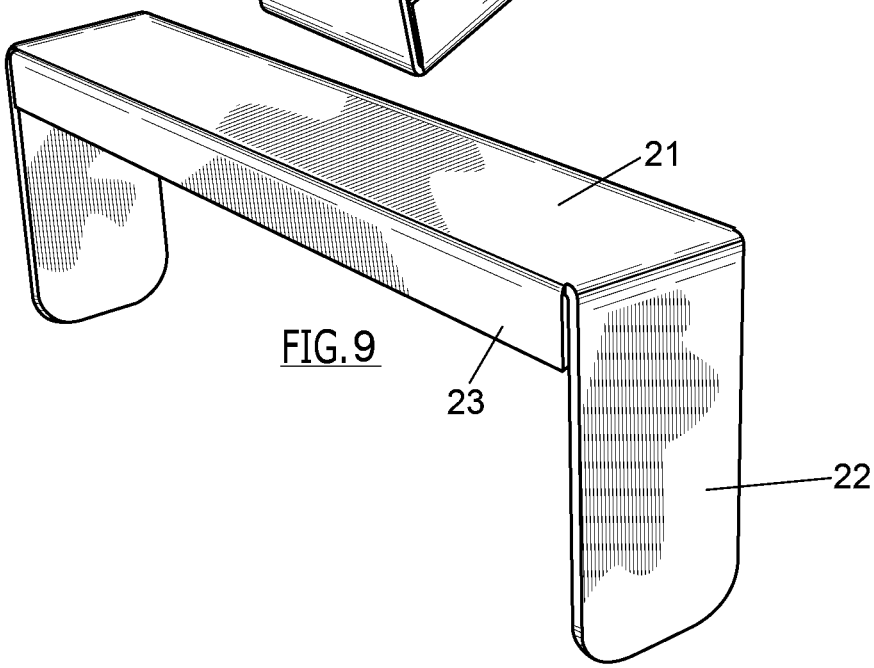
Figure 10:
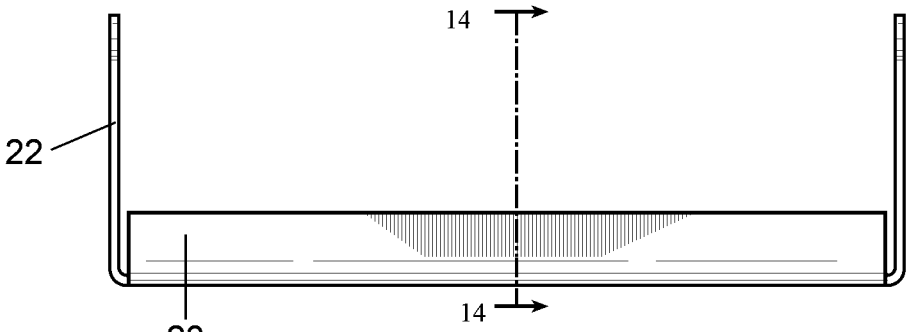
Figure 11:
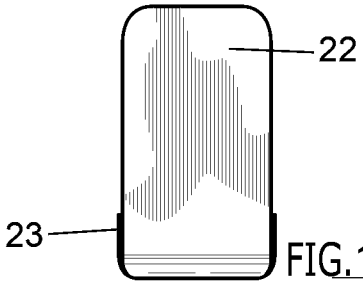
Figure 12:
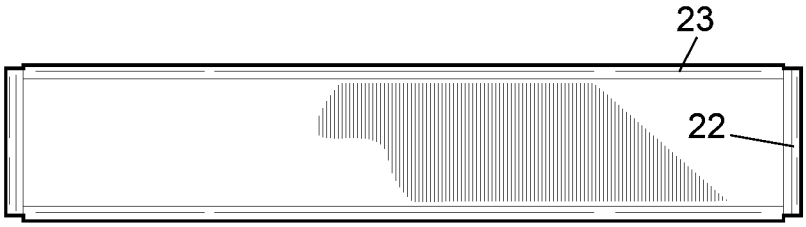
Figure 13:
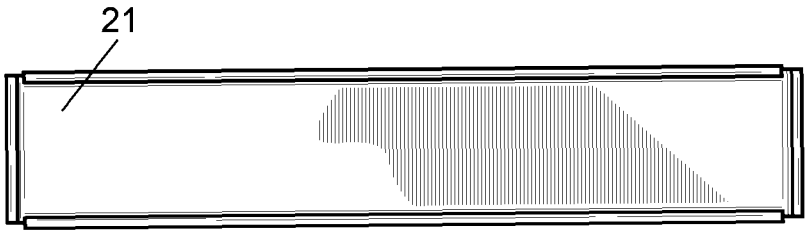
Figure 14:
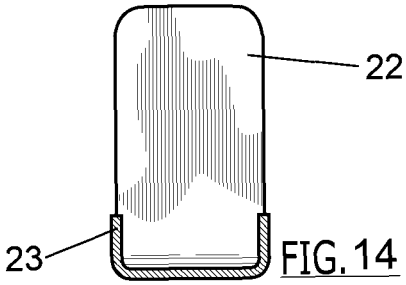
FIG. 14 is a cross-sectional view of the embodiment of the inner carrying handle shown in FIG. 10 taken in the direction of the arrows on line 14-14.
Figure 15:
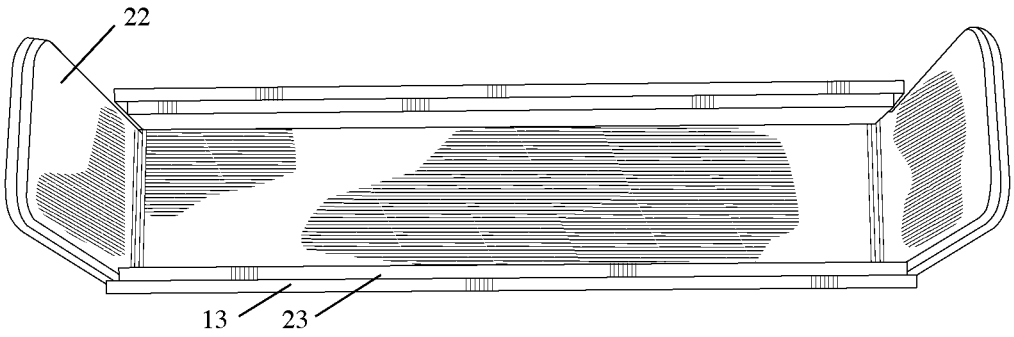
FIGS. 15-19 show one embodiment of the invention with the inner carrying handle positioned within the inner cavity of the outer carrying handle.
Figure 16:
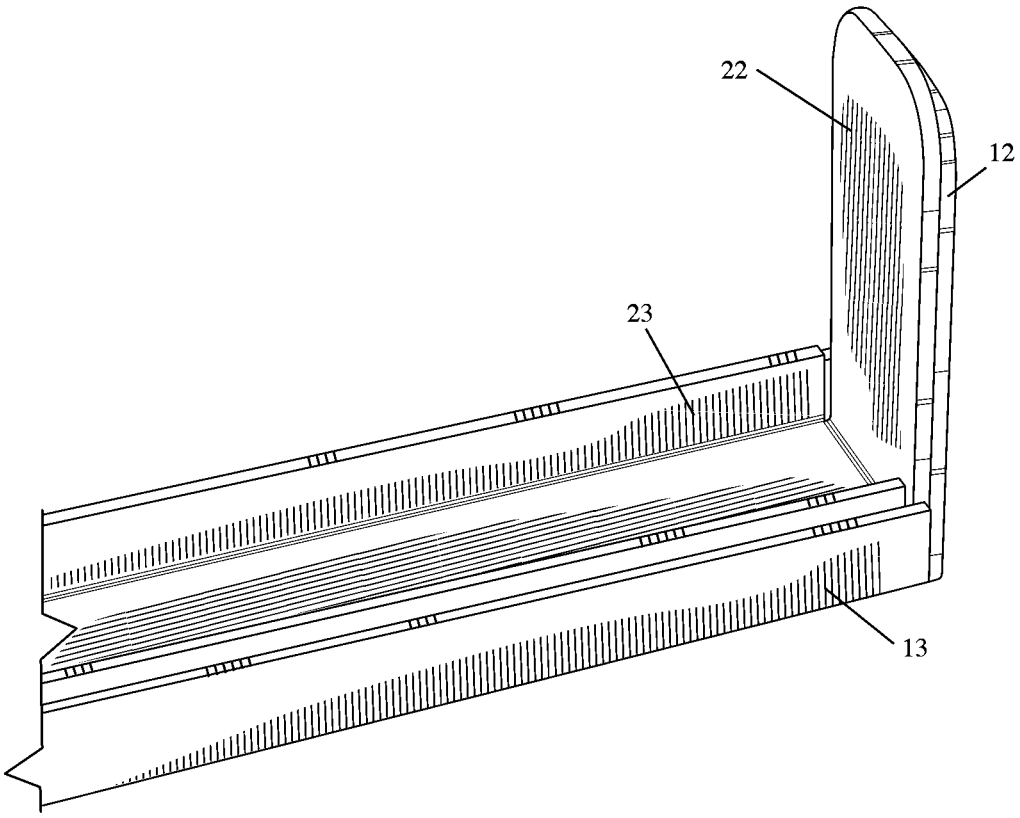
Figure 17:
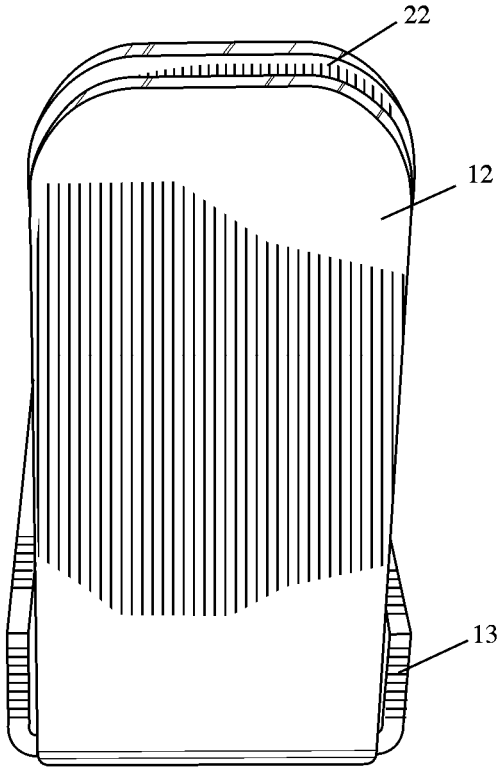
Figure 18:
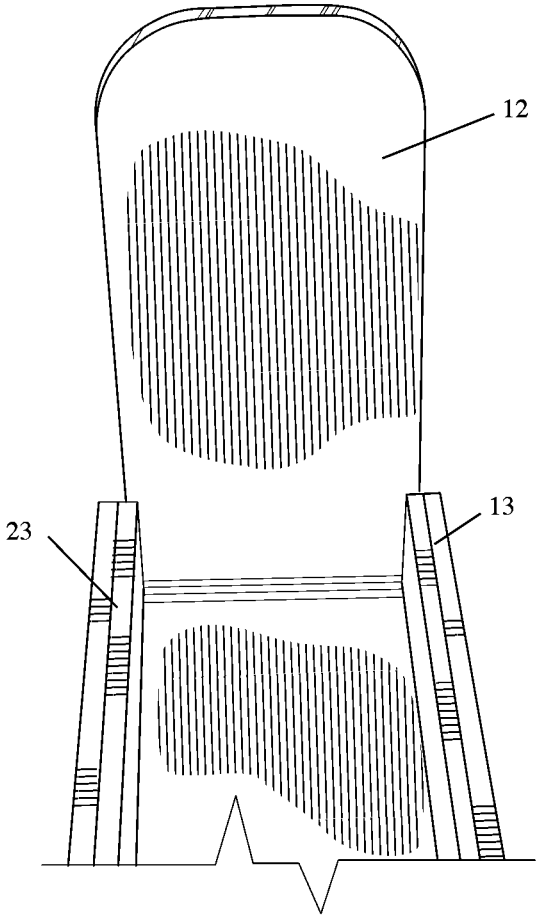
Figure 19:
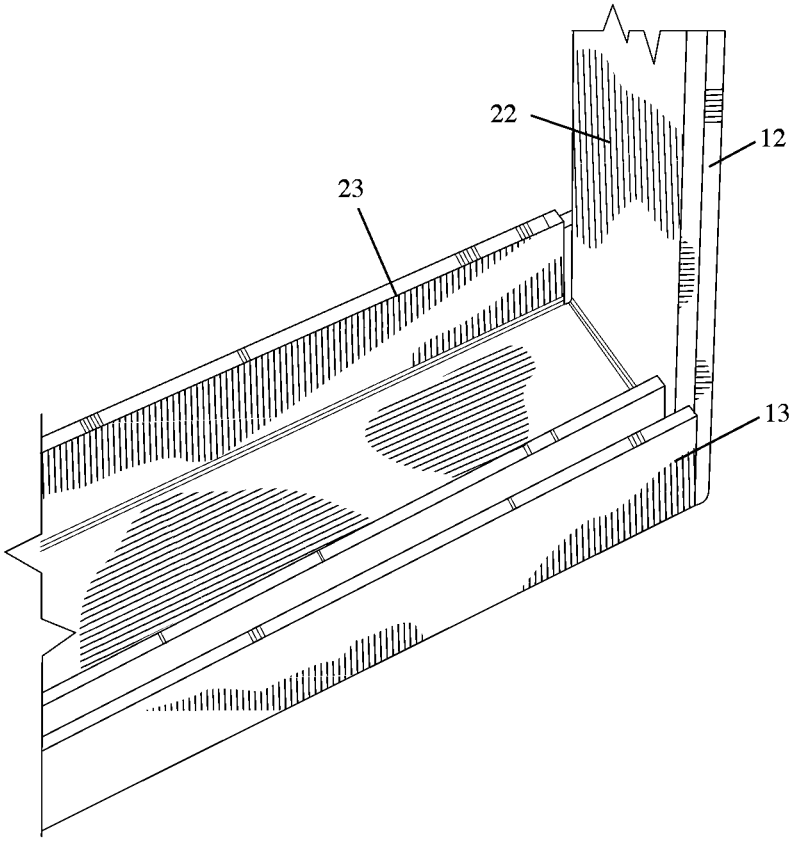
Figure 20:
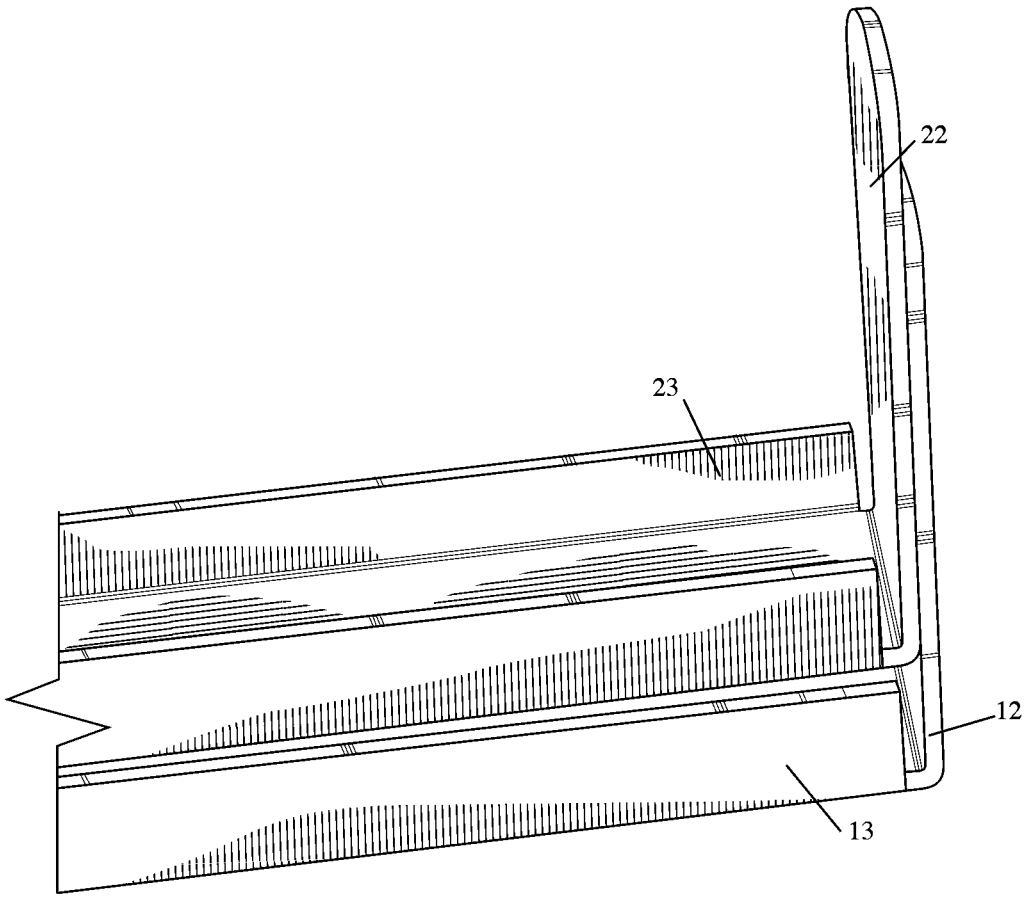
FIGS. 20 and 21 are partial perspective side views of the embodiment shown in FIGS. 15-19 with the inner carrying handle partially removed from the outer carrying handle's inner cavity.
Figure 21:
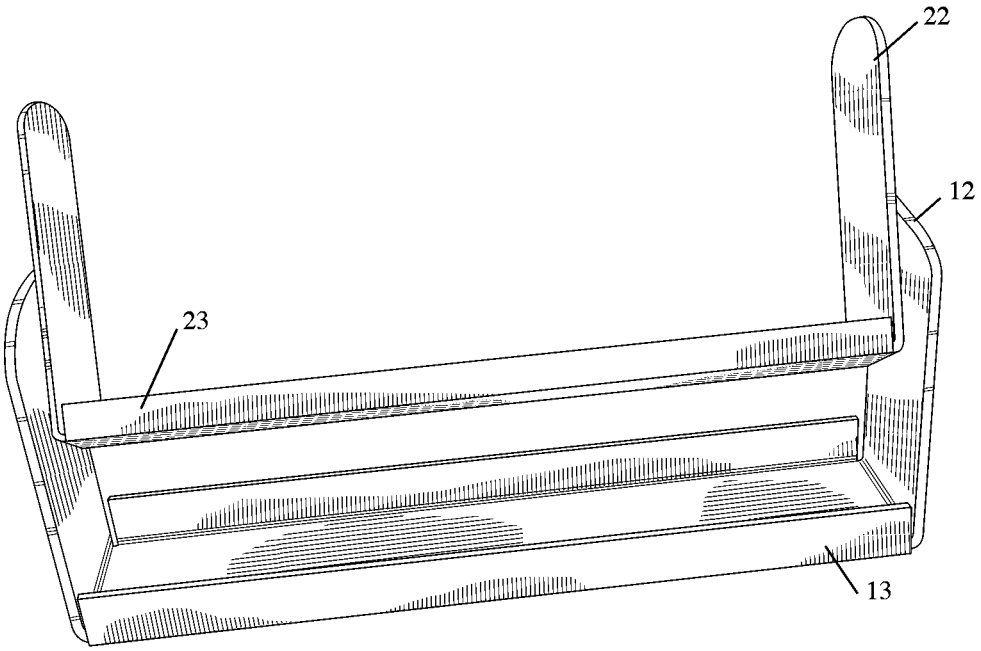
Figure 22:
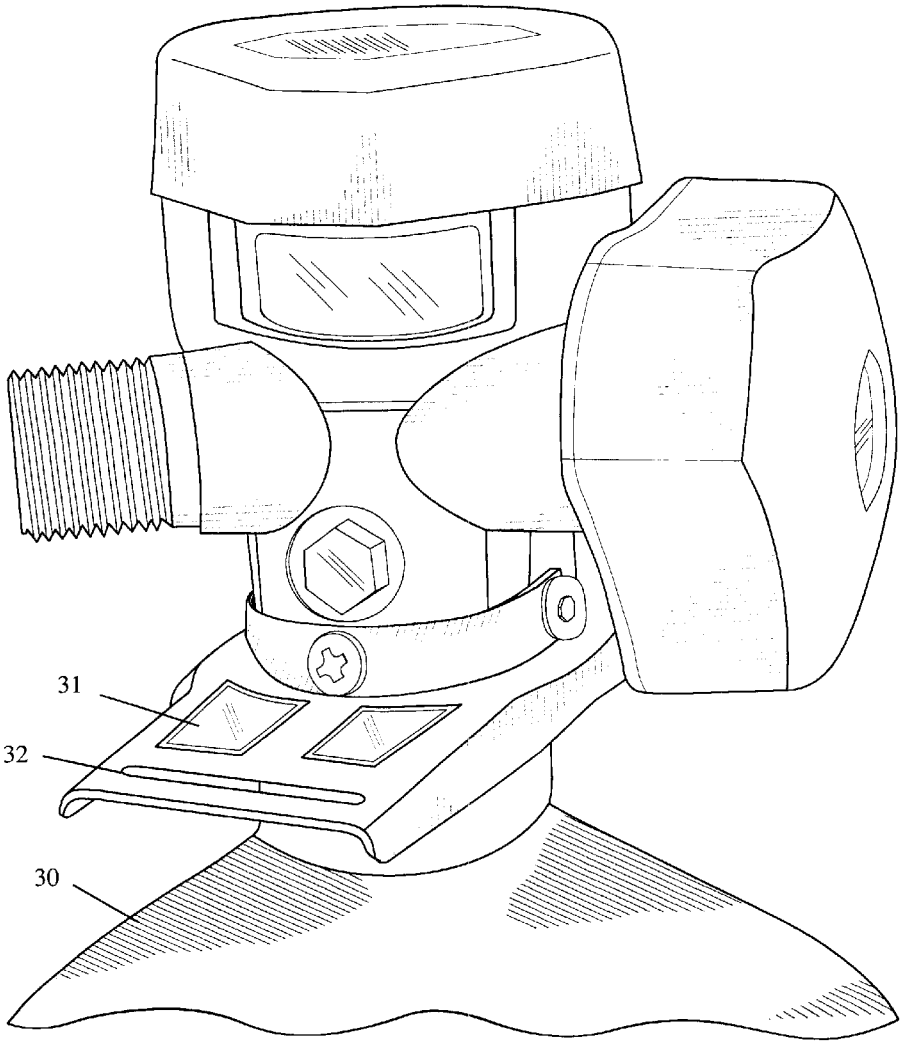
FIGS. 22-23 are a perspective and a top view respectively of a cylinder bracket on a cylinder tank.
Figure 23:
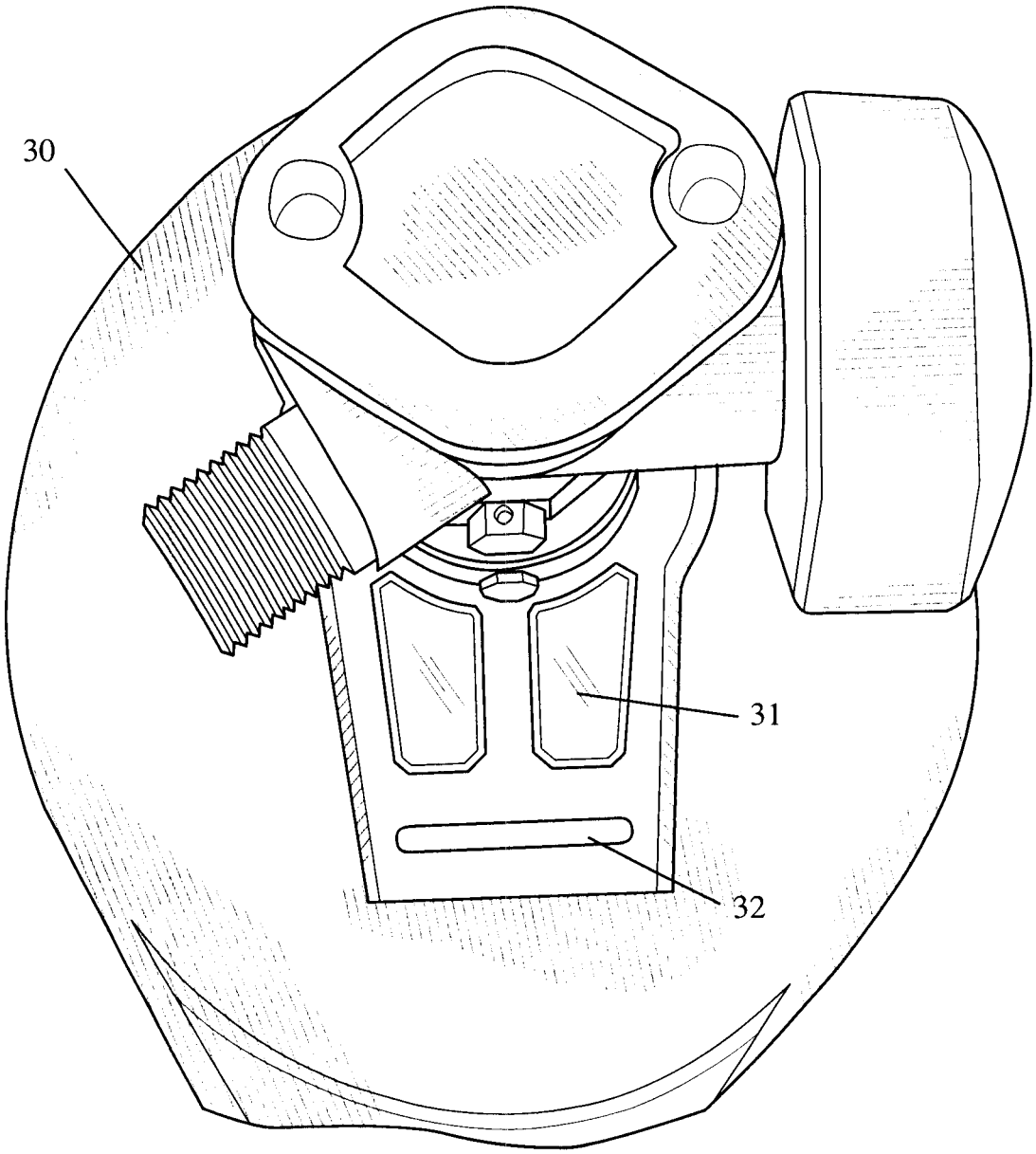

The accompanying drawings, which are incorporated in and constitute a part of this specification, illustrate embodiments of the carrying handle, together with the general description of the invention given above and the detailed description of an embodiment given below, serve to explain the principles of the present invention. Similar components of the device are similarly numbered for simplicity.

Referring to the Figures, for purposes of explanation, the invention is described below for an embodiment comprising two carrying handles it being understood that the invention is not limited to two carrying handles in all embodiments. To the contrary, the invention includes just one carrying handle, the combination of the two carrying handles, and more than two carrying handles.

For the embodiment with two carrying handles, the invention is comprised of an outer carrying handle and an inner carrying handle. Referring to FIGS. 1-7, the outer carrying handle 10 consists of a grip plate 11, a tab 12 at each end of the grip plate and a grip guard 13 at each side of the grip plate 11. The tabs 12 and grip guards 13 all extend away from the surface of the grip plate 11, together forming the inner cavity 14 of the outer carrying handle 10. In one embodiment of the invention, the grip plate 11, tabs 12 and grip guards 13 are integrally formed from a single piece of material, preferably stainless steel, with the various sections created by bending the material. For example, the outer carrying handle 10 could begin as a single flat piece of steel which is cut into a shape and then bent along four sections to form the various parts of the carrying handle.

The outer carrying handle's 10 grip plate 11 includes an outer surface and an inner surface. The grip plate 11 in one embodiment of the invention is approximately flat. The outer carrying handle's 10 tabs 12 and grip guards 13 extend away from the grip guard about perpendicular with respect to the surface of the grip plate 11. The length of the grip plate 11 shown in the figures is approximately 6.25 inches, although it is understood that many variations of the grip plate's 11 length can be used. The length of the present embodiment's outer carrying handle grip plate 11 shown in the figures is configured such that when the cylinders are stored on a rack, the outer carrying handle can engage two adjacent cylinders at once when positioned horizontally between the cylinders and allow the user to either remove or replace the two cylinders from or upon the rack at once. The length of the outer carrying handle grip plate 11 of the embodiment shown in the figures is also configured so as to allow the outer carrying handle 10 to accommodate cylinders of different diameters without the suspended cylinder tanks contacting (banging) each other when the carrying handle is used to carry the cylinders.

In one embodiment of the invention, the width of the grip plate 11, including the grip guards 13, is approximately 1.5 inches. The width of the grip plate 11 where the grip plate 11 is attached to the tabs 12 is preferably a little less than the width at the grip guards 13 although it need not be—the the width of the grip plate 11 where attached to the tabs 12 can be the same width as at the grip guards 13. It is understood that other dimensions may be used for the grip plate 11. Additionally, the grip plate 11 can be made to include different widths along its length, such as being thinner or wider at its center, ends, or having alternating widths across part of or its entire length. In one embodiment of the invention, the grip plate 11 is solid, smooth and approximately flat. Other embodiments of the invention may include a grip plate 11 that is curved and/or notched such as including grooves for placement of one's finger(s), and/or angular. The surface(s) of the grip plate 11 can be textured, polished, grooved and/or include an additional natural or synthetic material secured to its surface(s) to improve the grip-ability of the carrying handle and/or make it more ergonomic.

The grip plate 11 can include apertures which can be used to secure additional attachments to the carrying handle 10, and/or reduce the overall weight of the carrying handle. An example of an attachment that could be used is a device that attaches to two or more carrying handles, thereby allowing the user to carry four or more cylinders in one hand. The apertures can also be used to attach screws, bolts, pins, locks and other fasteners to the outer carrying handle 10 so as to secure the outer carrying handle 10 to the inner carrying handle 20 or to a cylinder 30, another device and/or structure. For example, the grip plate 11 may include an aperture at its center through which a fastener can be attached. The fastener could extend upward from the grip plate's inner surface. A rope, cable or chain could then be attached either to the fastener or directly to the carrying handle through the grip plate's aperture. The carrying handle with the attached rope, cable or chain could then be used to raise cylinders to otherwise inaccessible areas such as to fireman in remote areas of a high-rise building using a fire truck ladder or cherry picker. The fastener and rope can similarly be used to lower cylinders to rescuers or victims in an underground emergency. The grip plate's apertures may also be in the shape of various commonly sized nuts and bolts so as to allow the handle to be used (function) as a wrench when not attached to a cylinder.

The grip plate 11 can also be enclosed by a hand guard in a circular, rectangular or a variety of other shapes so that the user's hand is enclosed and protected while grasping the outer carrying handle 10. The hand guard(s) may extend upward from the grip plate's outer and/or inner surface(s) or from the outer carrying handles 10 tabs 12 and cover the region where the user's hand grasps the outer carrying handle 10, along the outer, inner or both surfaces of the grip plate 11. Other embodiments of the invention may include hand guards, both above and below the grip plate 11.

The outer carrying handle 10 may also, but need not include two grip guards 13 located on each side of the grip plate 11. The length of the grip guards 13 are preferably approximately equal to or less than the length of the outer handle's grip plate 11. The height of the grip guards 13 are less than half the width of the grip plate 11, preferably about ⅓ of the width of the outer handle's grip plate 11. The grip guards 13 in one embodiment of the invention are approximately ½ inch in height and 6 inches in length, although it is understood that other sizes for the grip guard's 13 length and height can be used.

A grip guard 13 can also be with a non-uniform height along its length and/or with relation to another grip guard 13.

In the embodiments shown, the outer carrying handle's 10 grip guards 13 are about perpendicular to the surface of the grip plate 11 (both the inside an outer surface) of the outer carrying handle 10 and extend slightly beyond the sides of the outer carrying handle's 10 tabs 12. The angle of the grip guards 13 in relation to the grip plate 11 can be varied and need not be perpendicular. The grip guards 13 can also be configured so as to be rounded, either slightly or so as to form a rounded tube-like structure along each side of the grip plate 11. Likewise the outer carrying handle 10 can be made without the grip guards 13 or with only one grip guard 13 on one side of the grip plate 11. The inclusion of the grip guards 13 at both sides of the grip plate 11 is preferred as the grip guards 13 add to the gripping comfort of the outer carrying handle 10 and further help to secure the inner carrying handle 20 in place when the inner carrying handle 20 is positioned within the inner cavity 14 of the outer carrying handle 10. Additionally, the seam between the grip guards 13 and the grip plate 11 (at the bends, or welds, or creases in the material when created from a single piece of metal) where the grip guards 13 are fixedly attached to the grip plate's 11 sides, add to the overall strength and rigidity of the outer carrying handle 10.

Preferably, the grip guards 13 are solid, smooth and approximately flat. Other embodiments of the invention may include grip guards 13 that are curved, notched, such as to include finger grooves, and/or angular. The grip guards 13 can be polished, textured, grooved, and/or include an additional natural or synthetic material secured to their surface to improve the grip-ability of the outer carrying handle 10 and/or make it more ergonomic. The grip guards 13 can include apertures which can be used to secure additional attachments to the outer carrying handle 10, and/or reduce the overall weight of the carrying handle.

Figure 24:
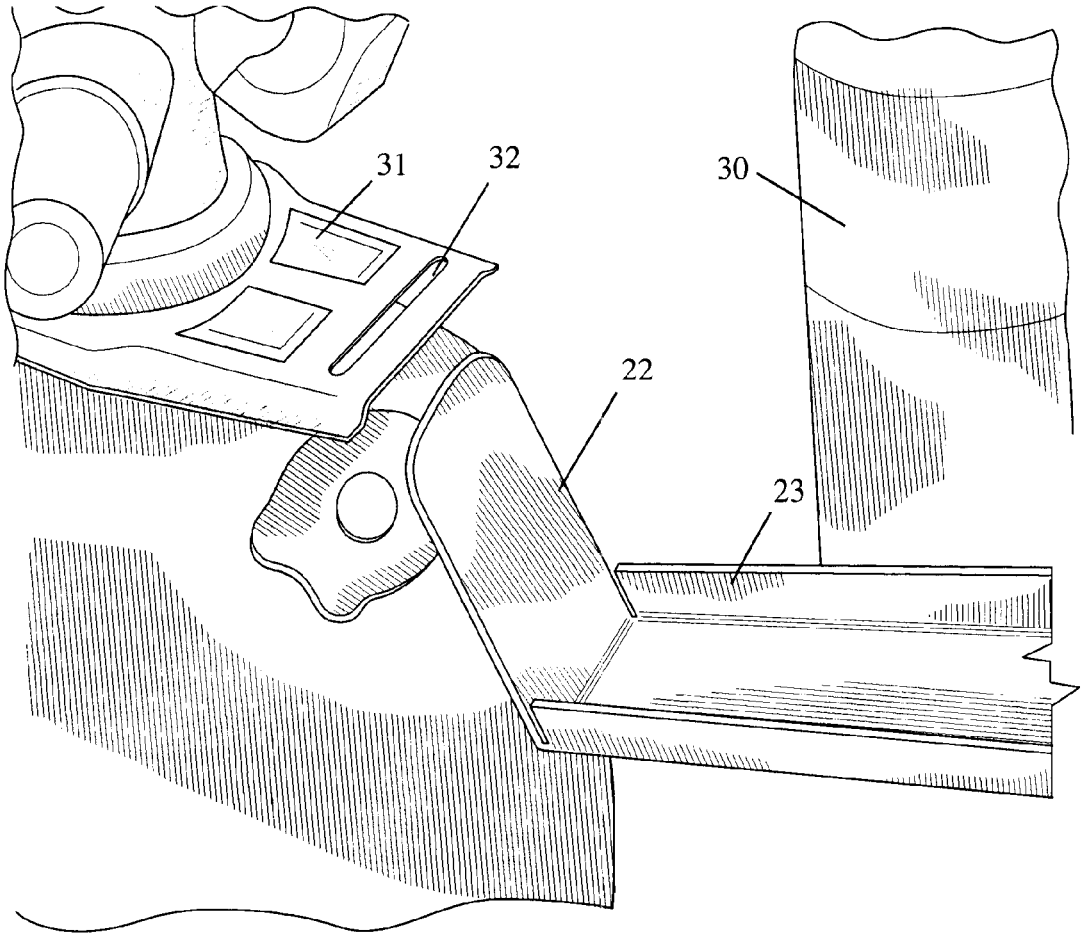
FIGS. 24-29 show the carrying handle engaging, disengaging and removably attached to the cylinder bracket slot of the cylinder tank shown in FIGS. 22-23.
Figure 25:
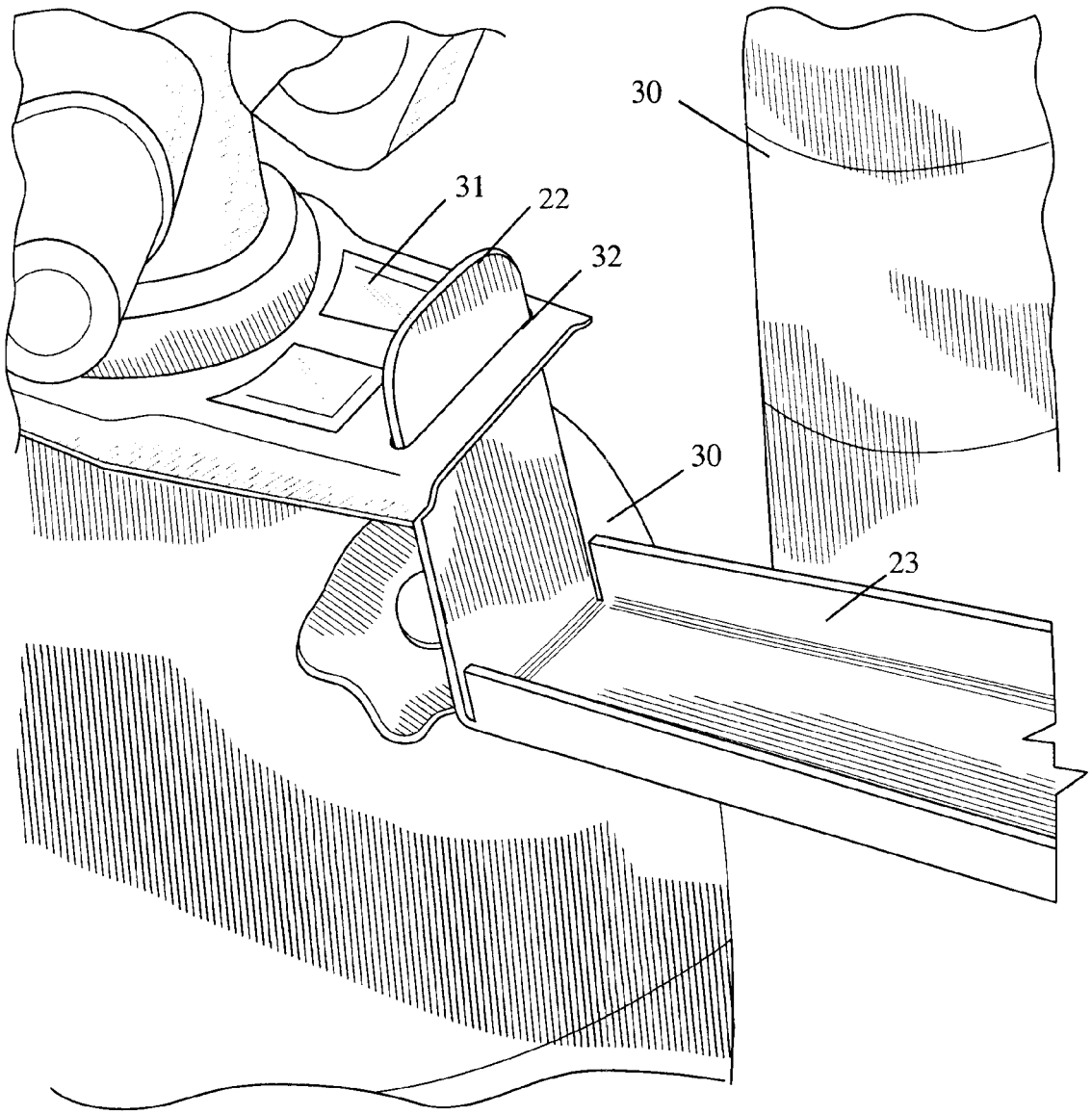
Figure 26:
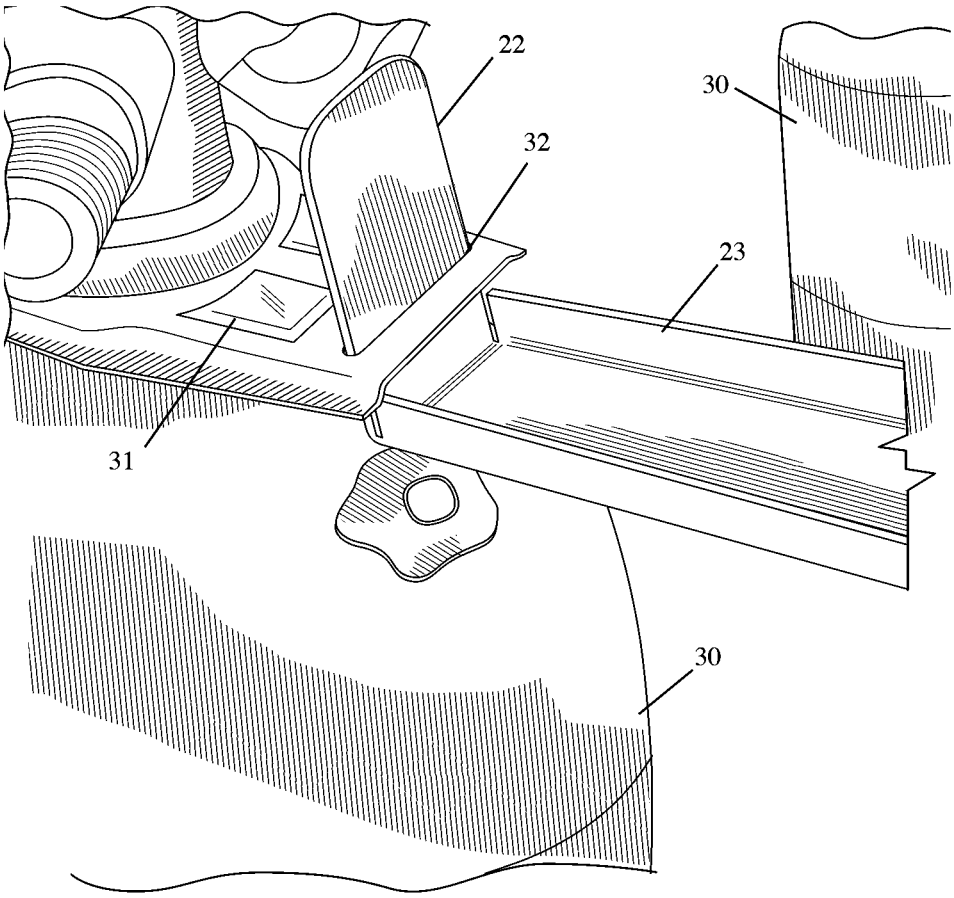
Figure 27:
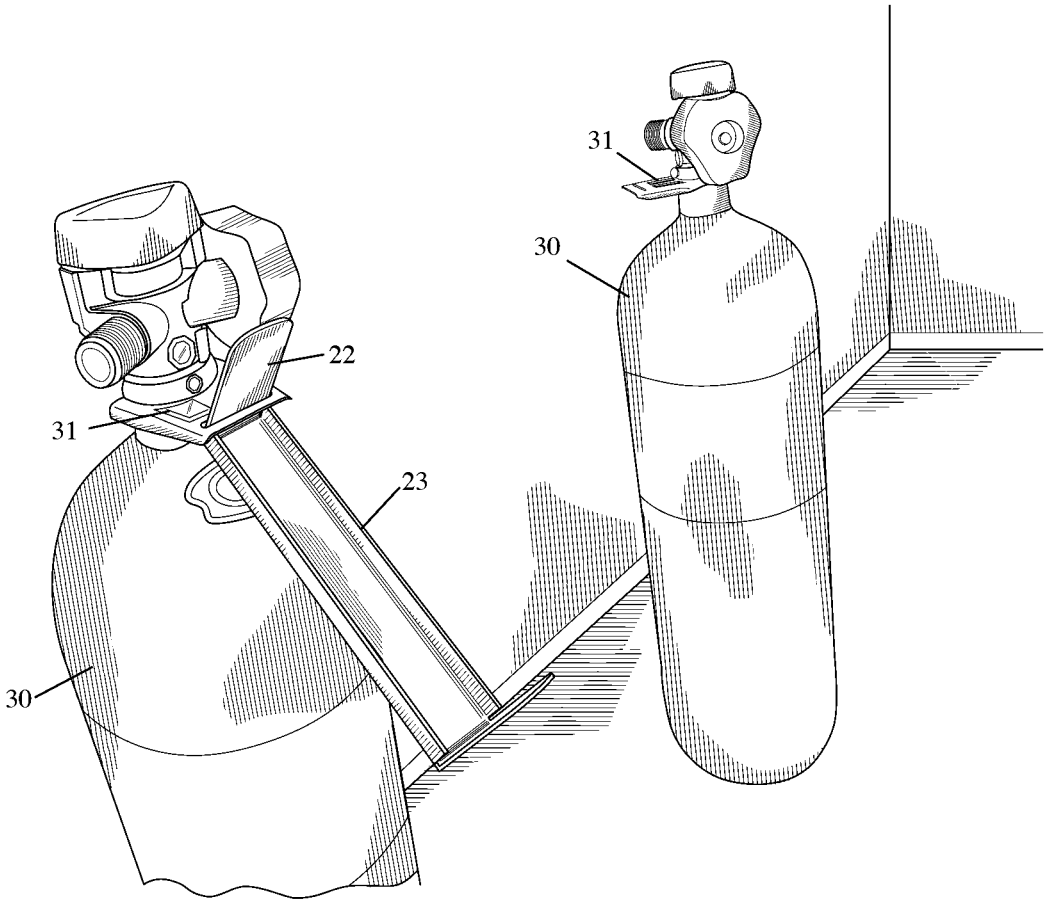
Figure 28:
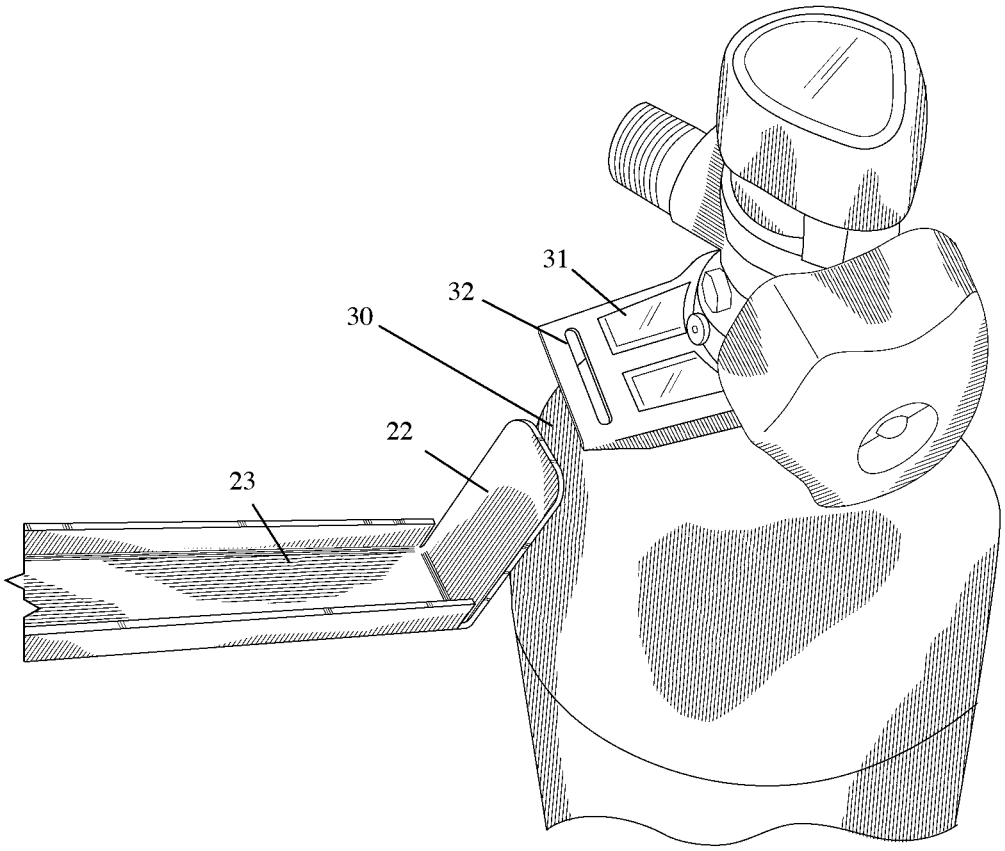

The outer carrying handle 10 includes tabs 12 that are fixedly attached to the outer carrying handle's grip plate 11 at each end of the grip plate 11. The tabs 12 each include an outer surface and an inner surface. The tabs 12 in one embodiment of the invention are approximately flat and feature rounded corners at their distal ends furthest away from the grip plate 11. The tabs 12, at their proximal ends, are fixedly attached to the ends of the grip plate 11. Although the tabs 12 are shown fixedly attached directly to the grip plate 11, they can also be connected using one or more hinges or other folding means installed where the tabs 12 attach to (meet) the grip plate 11 or anywhere along the length of the tabs 12. The hinge(s) would allow the tabs 12 to be folded either towards or away from the inner surface of the grip plate 11. Including such a hinge or other folding means would allow for the tabs 12 to be repositioned if necessary during use, to help removably secure the tabs 12 within the cylinder bracket slots 32 (see FIGS. 24-26), or during storage of the device, allowing the tabs 12 to be folded away, thereby making the device more compact.

The height of each tab 12 is preferably greater than the width of grip plate 11, but less than the length of grip plate 11. One embodiment of the invention includes tabs 12 that are approximately 2½ inches in height and 1 inch in width, although it is understood that other sizes for the tab heights and widths can be used.

Figure 29:
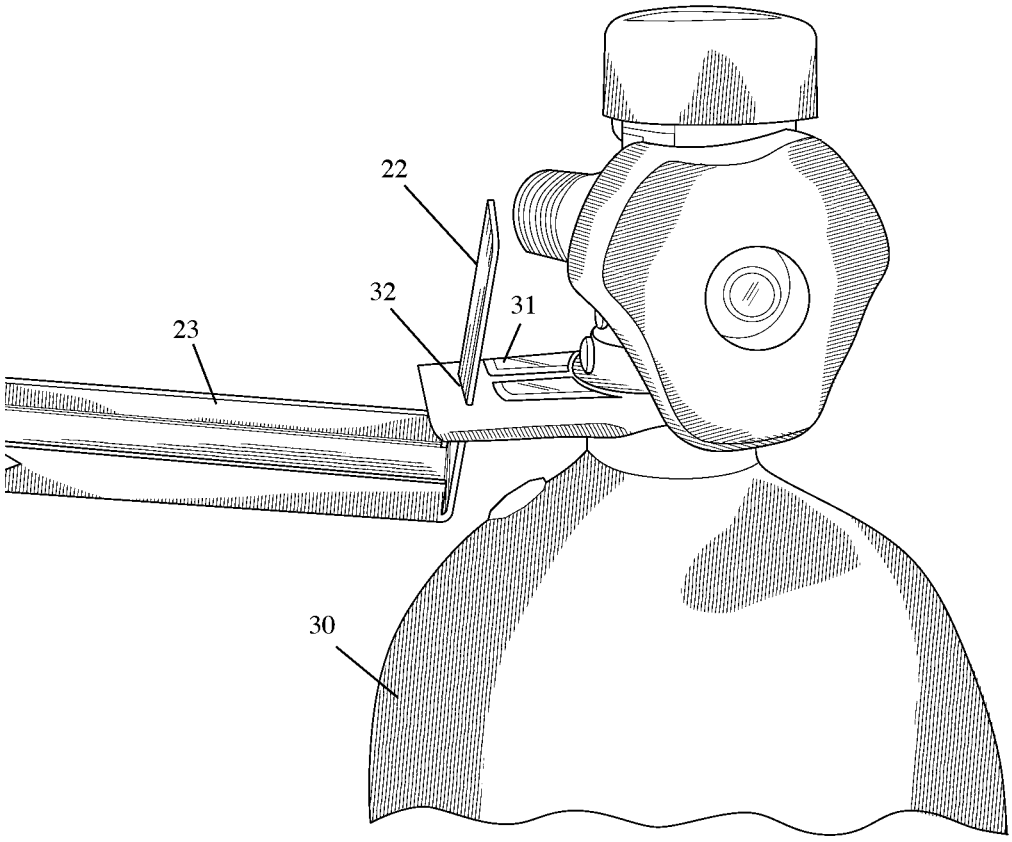
Figure 30:
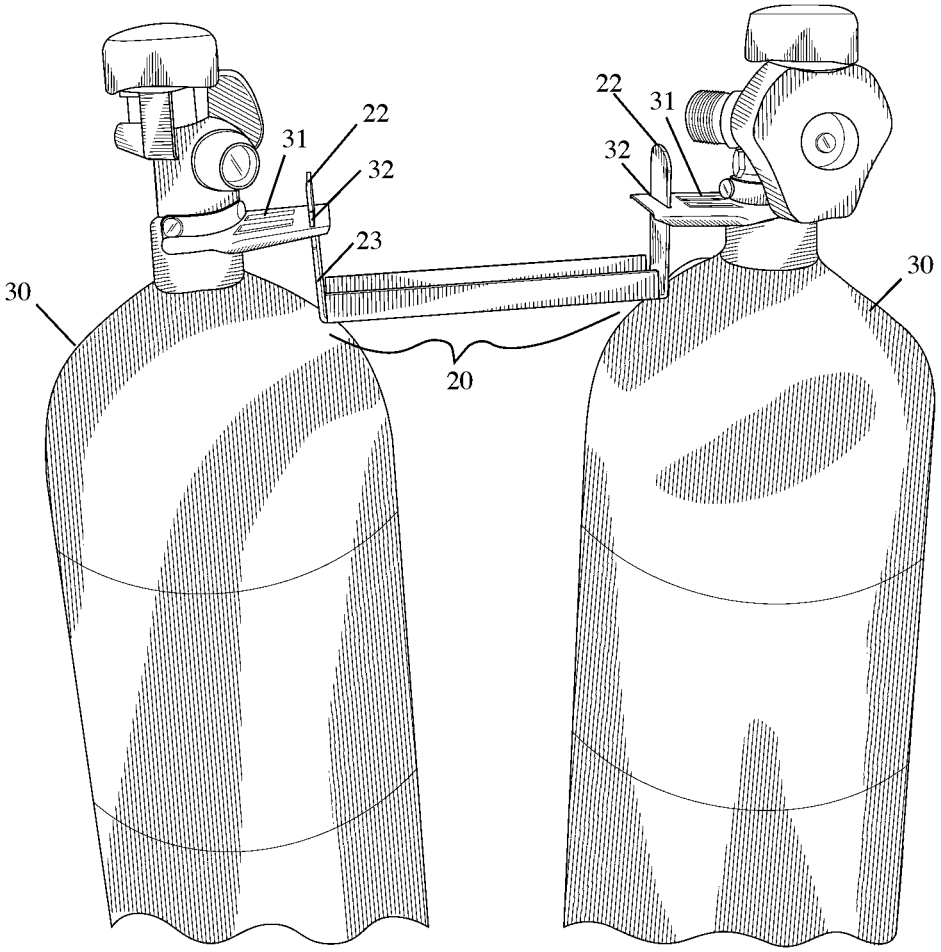
FIGS. 30-31 are perspective views and side views of the carrying handle shown engaging, disengaging and removably secured to the cylinder hanger slots of two cylinder tanks.
Figure 31:
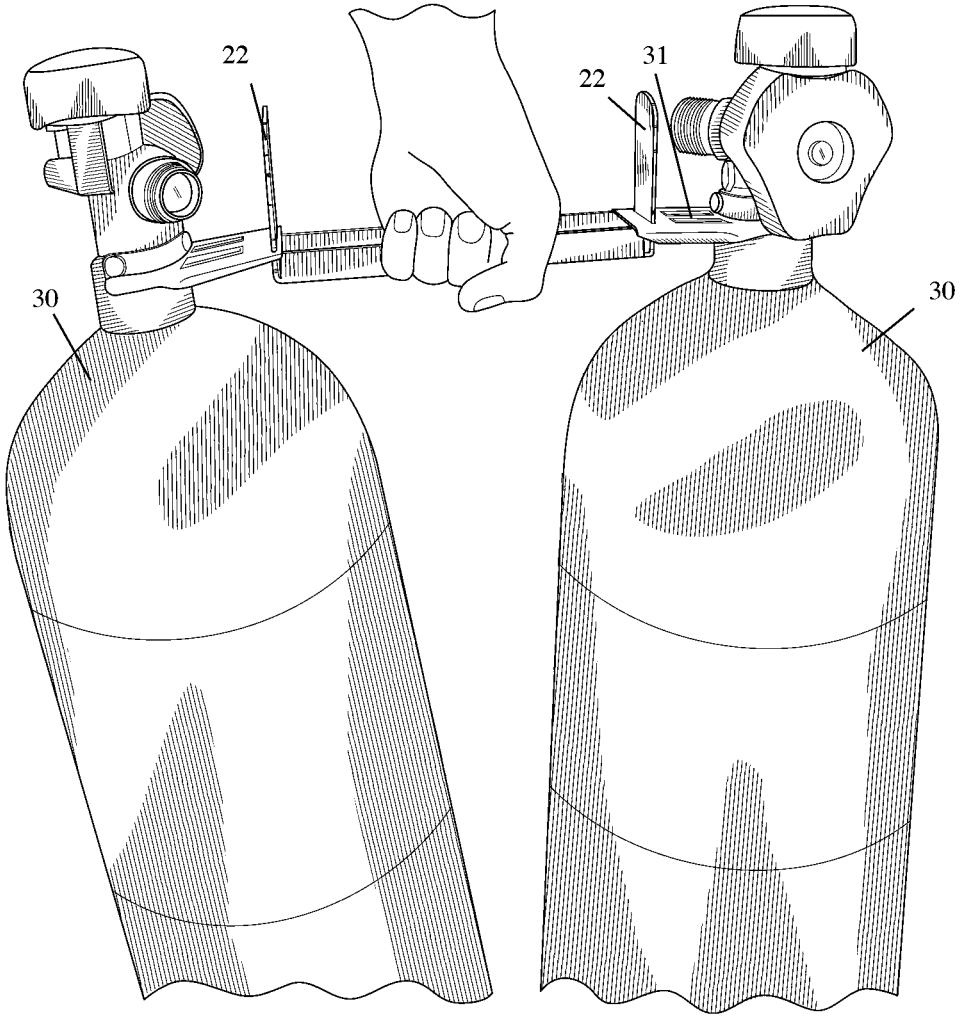

The tab 12 heights for the embodiment shown in the figures are advantageously configured to reduce the likelihood of tabs 12 disengaging the cylinder bracket slots 32 when the tabs 12 are installed within said slots. Referring to FIGS. 29-30, the tab 12 height allows the outer handle 10 to remain in the cylinder brackets 31 even when the outer handle 10 is installed on two cylinders 30 and the cylinders 30 are allowed to rest upon a wall or surface, without having to support the weight of the cylinders 30, regardless if the cylinders 30 are in an upright or horizontal position.

The tabs 12 are configured so as to be a complementary shape to the cylinder bracket slots 32 shown on the cylinder brackets 31 on cylinders 30, that is, slide through the bracket slots 32. The cylinder handle 10 may thus slideably attach to a cylinder 30. The specific configuration of the tab 12 may be varied so as to accommodate bracket slots 32 of different configurations (widths, lengths, and/or shapes). The tabs 12 may additionally have tapered widths, for example in a step like formation, along their lengths so that they can accommodate and be compatible with several different bracket slot sizes. The tabs 12 can also be made to vary in height across their width and/or with relation to each other. The outer carrying handle's 10 tabs 12 are configured about perpendicular to the grip plate 11 of the outer carrying handle 10, although in other embodiments the angle of the tabs 12 in relation to the grip plate 11 can be varied. The tabs 12 can also be configured so as to be round, angular, curved, wavy or made in other shapes. Additionally, the tabs 12 can be made to include different widths across their height, such as being wider at their center, ends or having alternating widths across part of or their entire heights. In one embodiment of the invention the surfaces of the tabs 12 are solid, smooth and approximately flat. Other embodiments of the invention may include tabs 12 with curved, notched, v-shaped, u-shaped and/or angular surfaces.

The surfaces of the tabs 12 can be polished, textured and/or rubberized to increase the friction created by their surfaces and any material they may come into contact with, including the bracket slots 32 and/or other carrying handles. The tabs 12 can also include apertures which can be used to secure additional attachments to the tabs 12, and/or to reduce the overall weight of the carrying handle. The apertures in the tabs 12 can also be used to install fasteners such as pins, bolts, screws, locks or other fastening means through or upon the tabs 12 to secure the tabs 12 to each other and/or to removably secure the outer carrying handle 10 to another carrying handle, to a cylinder bracket 32 or to another device and/or structure.

The outer carrying handle 10, including its grip plate 11, tabs 12 and grip guards 13, can be made of stainless steel or any other variety of materials, including but not limited to other metals, such as brass, aluminum, titanium, galvanized steel and iron. The outer carrying handle 10 can also be made of other materials such as plastic, carbon fiber, synthetic polymers or any suitable material which is rigid, light, strong and preferably resistant to chemicals, corrosion and heat. The thickness/gauge of the particular material used for fabrication can also be varied.

Although the outer carrying handle 10 is preferably described as being made from a single piece of material approximately 3 mm thick, the various sections of the outer carrying handle 10 can also be fabricated from different materials of varying thicknesses and as separate components. The separate components may then be permanently or removably mounted to each other through the use of adhesives, fasteners, or by welding them together. The outer carrying handle 10 can also be partially or entirely painted, plated or covered with a reflective or phosphorous, rubberized, metallic, synthetic or similar coating to add to its visibility, comfort, grip, durability and anti-corrosiveness. The various surfaces of the outer carrying handle 10 can also be configured to include a textured finish, such as knurling, which makes it easier for a user to grip the carrying handle 10 even when the carrying handle 10 is wet and/or slippery. The finishes applied to the inner and outer surfaces of the outer carrying handle 10 may also vary between surfaces, regions and components to maximize the functionality and usability of the carrying handle.

The embodiment of the invention with two carrying handles also includes an inner carrying handle 20 in addition to the outer handle 10. Referring to FIGS. 8-14, the inner carrying handle 20 is configured so as to securely but removably fit within the inner cavity 14 of the outer carrying handle 10. When installed within the inner cavity 14 of the outer carrying handle 10, at least some of the outer surfaces of the inner carrying handle 20 are in contact with the complementary inner surfaces of the outer carrying handle 10.

The inner carrying handle 20, like the outer carrying handle 10 is similarly comprised of a grip plate 21, tabs 22 and grip guards 23. The length and width of the inner carrying handle's grip plate 21 is slightly smaller that the grip plate 11 of the outer carrying handle 10 so that the inner carrying handle 20 can be securely fitted within the inner cavity 14 of the outer carrying handle 10. The height and width of the inner handle's tabs 22 are about equal to those of the outer carrying handle's tabs 12, but do not need to be. The height of the inner carrying handle's grip guards 23 is also approximately equal to the height of the outer carrying handle's 10 grip guards 13 although the length of the inner carrying handle's grip guards 23 is slightly less than that of the outer carrying 10 handle's grip guards 13. In contrast to the outer carrying handle 10, the grip guards 23 of the inner carrying handle 20 are positioned so that their outer surfaces are about even with the outside edges of the inner carrying handle's 20 tabs 22 along its width. This makes the width of the inner carrying handle's grip plate 21 narrower than the outer carrying handle, allowing it to fit between the grip guards 13 of the outer carrying handle 10.

The exterior configuration of the inner carrying handle 20 is complementary, both in shape and dimensions, to the inner cavity 14 of the exterior carrying handle 10. The components of the inner carrying handle 20 can be configured and created in numerous variations in accordance with what was discussed above for the corresponding components of the outer carrying handle 10. Likewise, the materials and finishes used to create the inner carrying handle 20 can also be changed in accordance with what was discussed for the outer carrying handle 10. Although for the embodiment of the invention shown in the figures there are only two carrying handles shown, additional carrying handles can also be made to fit either within the inner handle's 20 inner cavity 24 and/or to encase the outer carrying handle 10. Additional carrying handles can fit within or upon the consecutive carrying handles when each carrying handle is installed upon the next.

Procedure for Using the Carrying Handle(s):

Since the use of both the inner carrying handle 20 and outer carrying handle 10 with cylinders is the same, in describing the procedure for their use the handles will be referred to simply as carrying handles. Referring to FIGS. 15-21, the carrying handles, when not in use, are best kept and stored in the closed position with the inner carrying handle 20 fitted within the inner cavity 14 of the outer carrying handle 10. The inner carrying handle 20 is kept in position within the outer carrying handle 10 by a combination of one or more of tension created by inserting the inner carrying handle 20 between the outer carrying handle's tabs 12 and handle grips 13, friction between the outer surfaces of the inner carrying handle 20 and the inner surfaces of the outer carrying handle 10, or other securing means including latches or clasps and the like. The about rectangular shape of the carrying handles makes them fit neatly within the pockets of a fireman's coat or pants which are also most often approximately square/rectangular in shape.

The inner and outer carrying handles should first be separated from each other in order to use the device, although separation is not necessary for use. To separate two carrying handles, the user would have to apply a slight amount of pressure along the inner surface of the inner carrying handle's tabs 22 while firmly holding the outer surface of the outer carrying handle 10 so as to extract the inner carrying handle 20 from within the outer carrying handle's inner cavity 14. The force must be such so as to overcome the friction and tension that exists between the outer surfaces of the inner carrying handle 20 and those of the outer carrying handle's inner cavity 14. As pressure is applied, the inner carrying handle 20 slowly slides out of the outer carrying handle 10 until the two are completely separated. The procedure for using the inner and outer carrying handles to carry cylinders 30 is the same.

Figure 32:
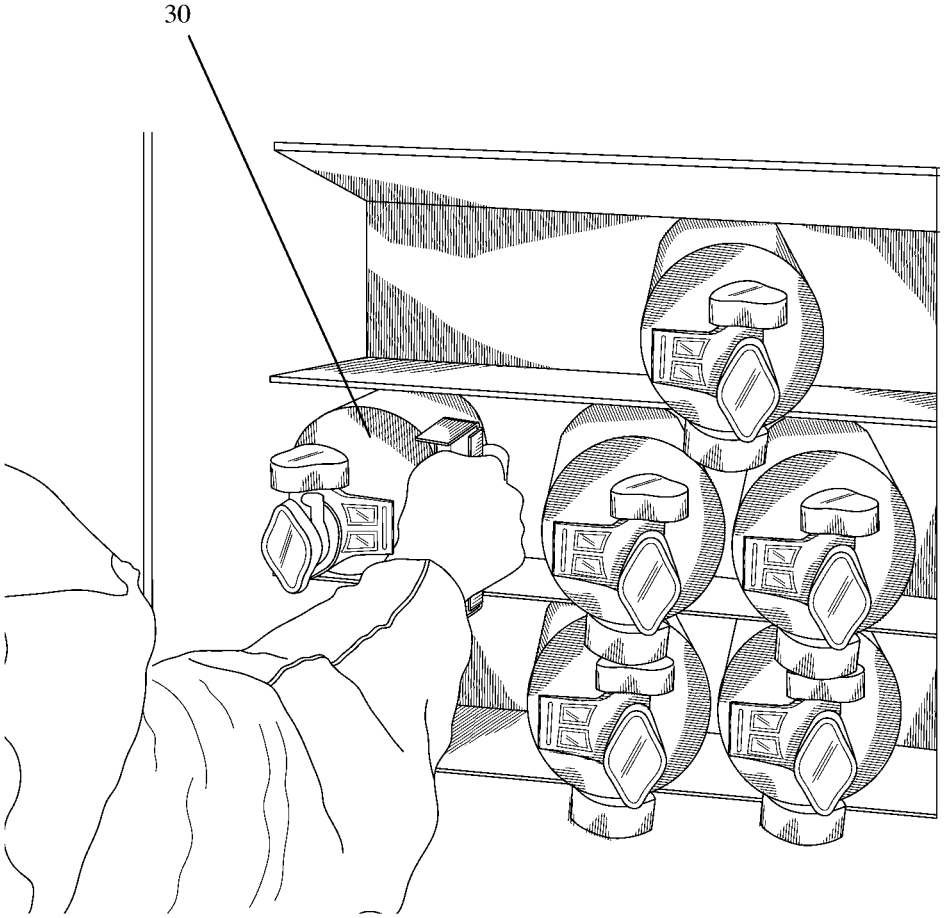
FIGS. 32-33 show the carrying handle used with cylinders on a cylinder rack.
Figure 33:
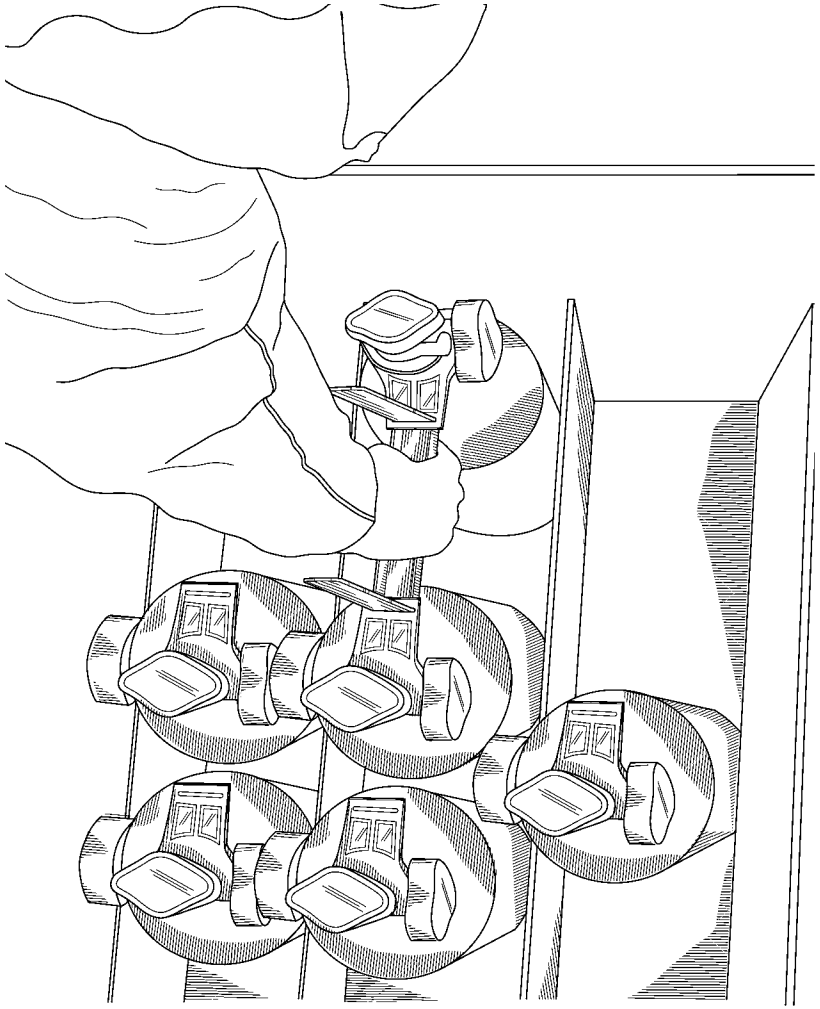

Oxygen cylinders are typically stored, both in the firehouse and on fire trucks, using cylinder racks (see FIGS. 32 and 33). To use the carrying handle on cylinders 30 stored upon a rack, the user must first make sure that the cylinder brackets 31 of the two adjacent cylinders 30 are facing each other. The bracket opening or slot 32 in the first cylinder bracket 31 should be about parallel to the other. FIGS. 22-31 show inner carrying handle 20 being used with cylinder 30, although it is understood that outer carrying handle 10 may be used in the exact same manner shown. The user grasps the inner carrying handle 20 so that his or her fingers wrap around the outer surfaces of the carrying handle grip plate 21 and grip guards 23 and so the tabs 22 are facing toward the user. With the inner carrying handle 20 gripped in one hand the user may then extend their hand, holding the inner carrying handle 20 between the two adjacent cylinders 30 (see FIG. 32). Once the distal end of the handle's tabs 22 has cleared the cylinder brackets 31 of the two cylinders 30, the user may then rotate the carrying handle 20 approximately ninety degrees, either clockwise or counterclockwise (see FIG. 33). In a retracting motion the user can then pull the carrying handle towards them being sure that the handle's tabs 22 engage (slide through) the bracket slots 32 on each of the two cylinders 30. Once fully engaged the cylinder brackets 31 of the two adjacent cylinders 30 will rest upon the inner surface of the tabs 22 and upon the upper edge of the grip guards 23. As the user continues to pull the carrying handle the cylinders 30 will slide forward. When taking the cylinders 30 off a shelf, the cylinders 30 will begin to slide off of their respective seats on the rack. To prevent the cylinder bases from abruptly falling or swinging towards the user, the user may support the cylinder housings using his/her free hand. When the cylinders 30 clear the rack the user may slowly rotate the carrying handle so that the cylinders 30 can controllably swing from their original about horizontal position to being suspended from the carrying handle and about perpendicular to the ground. As the cylinders 30 become fully suspended from the handle and the user releases his guiding hand from the cylinder housings the housings will hinge slightly inward with respect to the carrying handle so that the base and lower housing of the two suspended cylinders 30 come into contact with each other (see FIG. 31). When completely suspended from the carrying handle, depending on the cylinder sizes, the combined cylinders 30 and carrying handle form a delta like formation. The contact between the lower portions of the two cylinders helps to further stabilize the movement of the cylinders 30. This added stability makes for a more well-balanced load within the user's hand. The space between the upper housings of the cylinders 30 is consistently maintained when the carrying handle is in use because of the length of the handle's grip plate 21. The added length of the grip plate 21 allows the carrying handle to be used with cylinders of different sizes and ratings. Even if the user were to transport two of the larger 60 minute cylinders using the carrying handle, it would still be able to accommodate the larger cylinders without difficulty. The angle at which the two cylinders hinge towards each other when they are suspended from the carrying handle will decrease as the diameter of one or both of the cylinders increases.

The distance that is continuously maintained between the cylinders 30 by the carrying handle also has other advantages for its user. Firefighters often find themselves maneuvering through tight and confined spaces. Moving in these situations can be particularly difficult while trying to carry spare oxygen cylinders and equipment. The ability of the cylinders 30 to swing towards and away from each other while suspended from the carrying handle allow the user to manipulate the positioning of the cylinders 30 with respect to each other, the space in which he/she is in and the user's body as necessary. The user can move the cylinders 30 slightly apart so that the housing of each cylinder 30 rests on the user's legs and or body when trying to fit through a tight space. If the user decides to put the cylinders 30 down while transporting them he/she can do so by either resting the cylinders 30 either vertically on their bases and/or housing against a wall or laying them on the floor in a about horizontal position. When the cylinders 30 and carrying handle are placed in an about vertical position, the carrying handle will act to keep the cylinders 30 from moving apart and falling by holding them together. The added length of the carrying handle's tabs helps prevent the tabs from disengaging the bracket slots 32 of the cylinder brackets 31 even when the carrying handle is not supporting the entire weight of the cylinders 30. When the cylinders 30 and carrying handle are placed on the ground horizontally, the carrying handle helps to prevent the cylinders 30 from easily rolling apart. The length of the carrying handle's tabs prevents the tabs from disengaging the bracket slots 32 of the cylinder brackets 31 even when the carrying handle is not supporting the entire weight of the cylinders 30. To further ensure that the carrying handle does not unintentionally disengage the cylinder brackets 31, the user my install the carrying handle currently not in use, either the outer carrying handle 10 or inner carrying handle 20, upon the carrying handle that is being used to support the cylinders 30. This is accomplished by positioning the tabs of the two carrying handles within each other. By positioning the tabs of the inner carrying handle 20 within the inner surface of the outer carrying handle's tabs 12, so that the inner surfaces of the carrying handles' grip plates (13 and 23) are either perpendicular or parallel to each other, the user can further safeguard against the carrying handle's tabs from accidently sliding out of the bracket slots 32 when the carrying handle is in use.

When the user has finished transporting the cylinders 30 he/she can place the cylinders 30 on the ground, back on the rack, or rest them about vertically against a wall or object. To replace the two cylinders 30 in adjacent seats of the rack using a carrying handle, the user would simply follow the procedure previously used to remove them from said rack, only in the reverse order. To disengage the carrying handle from the cylinders 30, the user would slowly apply pressure to the inner surface of the carrying handle, including the inner surface of the grip plate and along the grip guards, so that the carrying handle's tabs begin to exit the bracket slots 32 of the cylinder brackets 31. Once the tabs have completely cleared and disengaged the cylinder brackets 31 the cylinders 30 can then be installed on a SCBA, used with an air powered rescue tool, serviced, recharged or returned to the storage rack. The carrying handles can then be placed back in their original closed position by positioning the inner carrying handle 20 and outer carrying handle 10 in like orientations, with all tabs and grip guards facing the same direction, and then pressing the outer carrying handle 10 over the inner carrying handle 20, with the outer surface of the inner carrying handle 20 leading, so that the inner carrying handle 20 slides within the inner cavity 14 of the outer carrying handle 10. The carrying handles can also be stored within each other by positioning the inner carrying handle 20 and outer carrying handle 10 in opposite orientations, with the tabs and grip guards of each handle facing each other, and then pressing the outer carrying handle 10 over the inner carrying handle 20 so that the inner carrying handle 20 slides within the inner cavity 14 of the outer carrying handle 10. Once returned to their original positions, the pair of carrying handles can then be placed back in the fireman's pocket, where they will remain readily accessible until the next time they are needed.

I claim:

1. A carrying handle for carrying two cylinder tanks each cylinder tank having cylinder brackets with slots therein comprising:

an elongated grip plate having an outer surface, an inner surface and four sides configured in an about rectangular shape having a length from a first end of the grip plate to a second end of the grip plate and having a width smaller than the length, said width being as the distance from a first side of said grip plate to a second side of said grip plate;

a tab configured in an about rectangular shape about equal in width, as measured from a first side of the tab a second side of said tab, to the width of the grip plate, said tab extending away from the first end of said grip plate about perpendicular to the inner surface of said grip plate;

a tab configured in an about rectangular shape about equal in width, as measured from a first side of the tab a second side of said tab, to the width of the grip plate, said tab extending away from the second end of said grip plate about perpendicular to the inner surface of said grip plate;

each said tab extending away from said grip plate a distance of about half the length of said grip plate;

the ends of said tabs furthest away from said grip plate having a thin rectangular shape configured to removably insert through an opening in a bracket on a cylinder tank;

wherein two cylinder tanks can be carried with one hand grasping the carrying handle when each of said tabs are removably inserted through an opening in a bracket on a cylinder tank.

2. The carrying handle according to claim 1, said grip plate further comprising a grip guard on each of said first side and said second side of said grip plate extending away from the inner surface of said grip plate in the same direction as the tabs;

said grip guards configured in an about rectangular shape shorter in length than the length of said grip plate; and said grip guards extending away from said grip plate a distance of less than half of the width of said grip plate.

3. The carrying handle according to claim 2, wherein said grip guards are curved inward towards said inner rectangular surface of said grip plate.

4. The carrying handle according to claim 2, said outer edges of said grip guards further comprising at least one notch configured for placement of a finger.

5. The carrying handle according to claim 1, said grip plate further comprising a slip resistant material fixedly attached to said outer surface of said grip plate.

6. The carrying handle according to claim 5, said grip guards further comprising a slip resistant material fixedly attached to said outer surface of said grip guards.

7. A pair of carrying handles each carrying handle capable of carrying two cylinder tanks, each cylinder tank having cylinder brackets with slots therein, comprising:

a first carrying handle and a second carrying handle, each carrying handle comprising:

an elongated grip plate having an outer surface, an inner surface and four sides configured in an about rectangular shape having a length from a first end of the grip plate to a second end of the grip plate and having a width smaller than the length, said width being as the distance from a first side of said grip plate to a second side of said grip plate;

a tab configured in an about rectangular shape about equal in width, as measured from a first side of the tab a second side of said tab, to the width of the grip plate, said tab extending away from the first end of said grip plate about perpendicular to the inner surface of said grip plate;

a tab configured in an about rectangular shape about equal in width, as measured from a first side of the tab a second side of said tab, to the width of the grip plate, said tab extending away from the second end of said grip plate about perpendicular to the inner surface of said grip plate;

each said tab extending away from said grip plate a distance of about half the length of said grip plate;

the ends of said tabs furthest away from said grip plate having a thin rectangular shape configured to removably insert through an opening in a bracket on a cylinder tank;

wherein two cylinder tanks can be carried with one hand grasping the carrying handle when each of said tabs are removably inserted through an opening in a bracket on a cylinder tank;

said inner surfaces of said grip plate, grip guards and tabs forming an inner cavity within said carrying handle;

wherein the outside dimensions of said first carrying handle is configured smaller than the inside dimensions of said second carrying handle such that said first carrying handle removably fits within said inner cavity of said second carrying handle by sliding the first carrying handle between the tabs on said second carrying handle until the outer surface of said grip plate on said first carrying handle is in close proximity to said inner surface of said grip plate on said second carrying handle.

8. The carrying handles according to claim 7, said grip plate on each carrying handle further comprising a grip guard on each of said first side and said second side of said grip plate extending away from the inner surface of said grip plate in the same direction as the tabs;

said grip guards configured in an about rectangular shape shorter in length than the length of said grip plate; and said grip guards extending away from said grip plate a distance of less than half of the width of said grip plate.

9. The carrying handles according to claim 8, wherein said grip guards are curved inward towards said inner rectangular surface of said grip plate.

10. The carrying handles according to claim 9, said outer edges of said grip guards further comprising at least one notch configured for placement of a finger.

11. The carrying handles according to claim 7, said grip plates further comprising a slip resistant material fixedly attached to said outer surface of said grip plate.

12. The carrying handles according to claim 11, said grip guards further comprising a slip resistant material fixedly attached to said outer surface of said grip guards.

* * * * *